US008201374B2

(12) United States Patent
Hohmann, Jr.

(10) Patent No.: US 8,201,374 B2
(45) Date of Patent: Jun. 19, 2012

(54) WIND LOAD ANCHORS AND HIGH-WIND ANCHORING SYSTEMS FOR CAVITY WALLS

(75) Inventor: Ronald P. Hohmann, Jr., Hauppauge, NY (US)

(73) Assignee: MiTek Holdings, Inc., Wilmington, DE (US)

( * ) Notice: Subject to any disclaimer, the term of this patent is extended or adjusted under 35 U.S.C. 154(b) by 37 days.

(21) Appl. No.: 12/422,082

(22) Filed: Apr. 10, 2009

(65) Prior Publication Data

US 2010/0257803 A1 Oct. 14, 2010

(51) Int. Cl.
*E04B 1/16* (2006.01)

(52) U.S. Cl. ..... 52/379; 52/506.05; 52/506.06

(58) Field of Classification Search ..... 52/378, 52/379, 506.01, 506.05, 506.06
See application file for complete search history.

(56) References Cited

U.S. PATENT DOCUMENTS

| | | | | | |
|---|---|---|---|---|---|
| 1,366,470 | A | * | 1/1921 | Lampert | 52/714 |
| 2,164,261 | A | * | 6/1939 | Small | 52/506.06 |
| 2,856,766 | A | * | 10/1958 | Huntley | 52/318 |
| 3,308,487 | A | * | 3/1967 | Birgbauer | 5/260 |
| 3,341,998 | A | * | 9/1967 | Lucas | 52/379 |
| 3,377,764 | A | | 4/1968 | Storch | |
| 4,021,990 | A | | 5/1977 | Schwalberg | |
| 4,373,314 | A | * | 2/1983 | Allan | 52/434 |
| 4,473,984 | A | | 10/1984 | Lopez | |
| 4,598,518 | A | | 7/1986 | Hohmann | |
| 4,869,038 | A | | 9/1989 | Catani | |
| 4,875,319 | A | | 10/1989 | Hohmann | |
| 5,392,581 | A | | 2/1995 | Hatzinikolas | |
| 5,408,798 | A | | 4/1995 | Hohmann | |
| 5,454,200 | A | | 10/1995 | Hohmann | |
| 5,456,052 | A | | 10/1995 | Anderson | |
| 5,507,546 | A | * | 4/1996 | Holley | 293/133 |
| 5,743,058 | A | * | 4/1998 | Boomsma | 52/481.2 |
| 5,816,008 | A | | 10/1998 | Hohmann | |
| 6,209,281 | B1 | | 4/2001 | Rice | |
| 6,279,283 | B1 | | 8/2001 | Hohmann | |
| 6,332,300 | B1 | * | 12/2001 | Wakai | 52/713 |
| 6,739,105 | B2 | * | 5/2004 | Fleming | 52/513 |
| 6,789,365 | B1 | | 9/2004 | Hohmann | |
| 6,925,768 | B2 | | 8/2005 | Hohmann | |
| 6,941,717 | B2 | | 9/2005 | Hohmann | |
| 7,017,318 | B1 | | 3/2006 | Hohmann | |
| 2001/0054270 | A1 | * | 12/2001 | Rice | 52/714 |
| 2004/0231270 | A1 | * | 11/2004 | Collins et al. | 52/506.01 |

OTHER PUBLICATIONS

Inderscience Publishers Article Abstract, Title: Increasing abutment friction at bolted joint interfaces through particle enhanced sealants, lines 1-4, (copyright 2004).*

Federal Emergency Management Agency (FEMA) Attachment of Brick Veneer in High-Wind Regions, Dec. 2005, 2 pages, United States.

* cited by examiner

*Primary Examiner* — Jeanette E Chapman
*Assistant Examiner* — Daniel Kenny
(74) *Attorney, Agent, or Firm* — Senniger Powers LLP

(57) ABSTRACT

High-wind load wall anchors and high-wind load wall anchoring systems for cavity walls are described which utilize double-walled anchor constructs with interengaging wire formative veneer ties. The high wind load anchors are mounted upon an interior cavity wall and the veneer ties are embedded within joints of an exterior cavity wall. The anchors have an aperture, for threading the veneer ties therethrough and restricting undesired movement, coupled with a double-walled wing structure to resist anchor deformation by high-wind forces. For resistance against seismic forces, the high-wind load wall anchoring system has a reinforcement wire which snaps into contoured veneer ties.

11 Claims, 7 Drawing Sheets

WIND LOAD ANCHORS AND HIGH-WIND ANCHORING SYSTEMS FOR CAVITY WALLS

BACKGROUND OF THE INVENTION

1. Field of the Invention

This invention relates to wall anchors and anchoring systems for cavity walls. More particularly, the invention relates to systems for cavity walls subjected to high-wind loading conditions.

2. Description of the Prior Art

Emergent conditions foster innovation. Dangerous conditions persist—tragedy strikes—change occurs. Whether it is a traffic light at a busy intersection or a less than substantial seawall facing a hurricane, society seems naturally to procrastinate.

Hurricane Katrina formed Aug. 23, 2005 and reached peak strength on Aug. 28, 2005 with one-minute sustained winds of 175 mph. In December 2005, the Federal Emergency Management Agency (FEMA) issued an analysis of Attachment of Brick Veneer in High-Wind Regions. Even with such a remarkable background, the anchoring of brick veneer to a variety of backup walls faces a dearth of standards.

The FEMA analysis of brick veneer failures modes are, in turn, categorized as human failures—used wrong fasteners; misaligned tie during installation; ties not installed; improper tie spacing; and used mortars of poor quality—and as mechanical failures—one-piece, corrugated ties (lacking compressive strength); fastener failure; structure provided inadequate embedment; and corrosion failures.

In the past, Ronald P. Hohmann and Ronald P. Hohmann, Jr., the inventors hereof, have solved several similar technical problems. Their inventions have been in response to changes in Uniform Building Code provisions and to investigations into effects of various forces, particularly lateral forces, upon brick veneer construction. The resultant products distributed under the Seismiclip® and DW-10-X® trademarks (manufactured by Hohmann and Barnard, Inc., Hauppauge, N.Y. 11788) have become widely accepted in the industry.

Later patents in this area assigned to Hohmann and Barnard, Inc., include U.S. Pat. Nos. 5,454,200 ('200); 6,789,365 ('365); 6,925,768 ('768); and, 6,941,717 ('717). The Hohmann '200 patent was directed to adding reinforcement to the outer wythe and improving the uniformity of the distribution of lateral forces therein. This patent did not resolve high-strength requirements at the inner wythe or teach about the insulation/wall anchor interrelationship.

In the Hohmann '365 patent, low-profile anchor configurations are taught. This development arose from, inter alia, the Energy Code Requirement, Chapter 13 (78 CMR, Seventh Edition; Boston, Mass.). With this requirement the need for higher R-value insulation perforce increased the cavity size and the technological improvement taught by the patent resolved the high-strength vs. high-span dilemma created thereby.

Hohmann '768 and '717 effectuated structural changes to the wall anchor shown in Hohmann, U.S. Pat. No. 4,598,518 and enabled the maintenance of insulation integrity with surface mounted, pronged veneer anchors.

In the course of preparing this disclosure several patents became known to the inventors hereof. The following patents are believed to be relevant and those not discussed hereinabove are discussed further as to the significance thereof.

| Patent | Inventor | Issue Date |
|---|---|---|
| 7,017,318 | Hohmann et al. | Mar. 28, 2006 |
| 6,941,717 | Hohmann et al. | Sep. 13, 2005 |
| 6,925,768 | Hohmann et al. | Aug. 9, 2005 |
| 6,789,365 | Hohmann et al. | Sep. 14, 2004 |
| 6,279,283 | Hohmann et al. | Aug. 28, 2001 |
| 6,209,281 | Rice | Apr. 3, 2001 |
| 5,816,008 | Hohmann | Oct. 15, 1998 |
| 5,456,052 | Anderson et al. | Oct. 10, 1995 |
| 5,454,200 | Hohmann | Oct. 3, 1995 |
| 5,408,798 | Hohmann | Apr. 25, 1995 |
| 5,392,581 | Hatzinikolas et al. | Feb. 28, 1995 |
| 4,875,319 | Hohmann | Oct. 24, 1989 |
| 4,869,038 | Catani | Sep. 26, 1989 |
| 4,598,518 | Hohmann | Jul. 8, 1986 |
| 4,473,984 | Lopez | Oct. 2, 1984 |
| 4,373,314 | Allen | Feb. 15, 1983 |
| 4,021,990 | Schwalberg | May 10, 1977 |
| 3,377,764 | Storch | Apr. 16, 1968 |

It is noted that with some exceptions these devices are generally descriptive of wire-to-wire anchors and wall ties and have various cooperative functional relationships with straight wire runs embedded in the interior and/or exterior wythe. Several of the prior art items are of the pintle and eyelet/loop variety.

Storch—U.S. Pat. No. 3,377,764—Issued Apr. 16, 1968

Discloses a bent wire, tie-type anchor for embedment in a facing exterior wythe engaging with a loop attached to a straight wire run in a backup interior wythe.

B. J. Schwalberg—U.S. Pat. No. 4,021,990—Issued May 10, 1977

Discloses a dry wall construction system for anchoring a facing veneer to wallboard/metal stud construction with a pronged sheetmetal anchor. Like Storch '764, the wall tie is embedded in the exterior wythe and is not attached to a straight wire run.

J. A. Allan—U.S. Pat. No. 4,373,314—Issued Feb. 15, 1983

Discloses a vertical angle iron with one leg adapted for attachment to a stud; and the other having elongated slots to accommodate wall ties. Insulation is applied between projecting vertical legs and adjacent angle irons with slots being spaced away from the stud to avoid the insulation.

Lopez—U.S. Pat. No. 4,473,984—Issued Oct. 2, 1984

Discloses a curtain-wall masonry anchor system wherein a wall tie is attached to the inner wythe by a self-tapping screw to a metal stud and to the outer wythe by embedment in a corresponding bed joint. The stud is applied through a hole cut into the insulation.

M. J. Catani—U.S. Pat. No. 4,869,038—Issued Sep. 26, 1989

Discloses a veneer wall anchor system having in the interior wythe a truss-type anchor with horizontal sheetmetal extensions. The extensions are interlocked with bent wire pintle-type wall ties that are embedded within the exterior wythe.

R. Hohmann—U.S. Pat. No. 4,875,319—issued Oct. 24, 1989

Discloses a seismic construction system for anchoring a facing veneer to wallboard/metal stud construction with a pronged sheetmetal anchor. Wall tie is distinguished over that of Schwalberg '990 and is clipped onto a straight wire run.

Hatzinikolas et al.—U.S. Pat. No. 5,392,581—Issued Feb. 28, 1995

Discloses a cavity-wall anchor having a conventional tie wire for mounting in the brick veneer and any-shaped sheetmetal bracket for mounting vertically between side-by-side blocks and horizontally atop a course of blocks. The bracket has a slit which is vertically disposed and protrudes into the cavity. The slit provides for a vertically adjustable anchor.

Hohmann—U.S. Pat. No. 5,408,798—issued Apr. 25, 1995

Discloses a seismic construction system for a cavity wall having a masonry anchor, a wall tie, and a facing anchor. Sealed eye wires extend into the cavity and wire wall ties are threaded therethrough with the open ends thereof embedded with a Hohmann '319 (see supra) clip in the mortar layer of the brick veneer.

Anderson et al.—U.S. Pat. No. 5,456,052—Issued Oct. 10, 1995

Discloses a two-part masonry brick tie, the first part being designed to be installed in the inner wythe and then, later when the brick veneer is erected to be interconnected by the second part. Both parts are constructed from sheetmetal and are arranged on substantially the same horizontal plane.

Hohmann—U.S. Pat. No. 5,816,008—Issued Oct. 15, 1998

Discloses a brick veneer anchor primarily for use with a cavity wall with a drywall inner wythe. The device combines an L-shaped plate for mounting on the metal stud of the drywall and extending into the cavity with a T-head bent stay. After interengagement with the L-shaped plate the free end of the bent stay is embedded in the corresponding bed joint of the veneer.

Rice—U.S. Pat. No. 6,209,281—Issued Apr. 3, 2001

Discloses a masonry anchor having a conventional tie wire for mounting in the brick veneer and sheetmetal bracket for mounting on the metal-stud-supported drywall. The bracket has a slit for adjustability of the tie wire, which slit is vertically disposed in the cavity when the bracket is mounted on the metal stud. For installation, this anchor requires an opening through the sheetrock into the cavity.

Hohmann et al.—U.S. Pat. No. 6,279,283—Issued Aug. 28, 2001

Discloses a low-profile wall tie primarily for use in renovation construction where in order to match existing mortar height in the facing wythe a compressed wall tie is embedded in the bed joint of the brick veneer.

Hohmann et al.—U.S. Pat. No. 7,017,318—Issued Mar. 28, 2006

Discloses a high-span anchoring system for a cavity wall wire-to-wire anchor. The structure includes wall reinforcements in both inner and outer wythes. Wire wall anchors extending from the inner wythe and passing through the insulation are compressed to optimize sealing thereabout.

None of the above provide the masonry cavity wall construction system for an inner masonry wythe and an outer facing wythe with high-span anchoring wire formatives as described hereinbelow.

SUMMARY

In general terms, the wind load anchors and high-wind load anchoring systems disclosed hereby are an integral part of the strengthening system for cavity wall structures. The wall anchor is surface mounted on the inner wythe for disposition in the wall cavity. The wall anchor works in conjunction with installed insulation to preclude penetration of air, moisture and water vapor into the structure. The wall anchor comprises a base and at least one double-walled wing containing an aperture to hold a veneer tie.

The double-walled wing is a singular planar wall structure either folded and fused onto itself or fused with a separate singular planar wall structure to form a juncture. The doubling of the singular planar wall structure provides greater pull resistance. For maximum pull resistance, the juncture aligns with the midpoint of the singular planar wall structure. The single double-walled wing structure is mounted either vertically or horizontally allowing for on-site determinations of preferred methods of installation.

A veneer tie is embedded in the bed joint of the outer wythe. For resistance against seismic forces, the high-wind load wall anchoring system has a reinforcement wire which snaps into contoured veneer ties. To minimize thermal transfer, insulative sealing washers are utilized when the anchoring system is mounted on a dry wall inner wythe containing metal support columns.

OBJECTS AND FEATURES OF THE INVENTION

It is an object of the present invention to provide new and novel high-wind load anchoring systems for cavity walls, which systems are surface mountable to the backup wythe thereof.

It is another object of the present invention to provide high strength through double-walled construction.

It is yet another object of the present invention provide an anchoring system for preventing disengagement under high-wind load or other environmental conditions.

It is still yet another object of the present invention to provide an anchoring system which is constructed to maintain insulation integrity by preventing air and water penetration and to maintain the seal between adjacent insulative panels.

It is another object of the present invention that the anchor plate is formed so that juncture of the double walled wing is aligned with the midpoint of the anchor plate to provide maximum pull resistance.

It is a feature of the present invention that the baseplate is mountable with the tie-receiving slot oriented vertically or horizontally.

It is another feature of the present invention that the wall anchor constructs hereof are mounted so to extend through the seams between the insulation panels which seams seal about the wall anchor.

It is yet another feature of the present invention that the bearing area between the wall anchor and the stud of the backup area spreads the forces thereacross a wide area thereby avoiding pin-point loading.

Other objects and features of the invention will become apparent upon review of the drawing and the detailed description which follows.

BRIEF DESCRIPTION OF THE DRAWINGS

In the following drawing, the same parts in the various views are afforded the same reference designators.

DESCRIPTION OF THE PREFERRED EMBODIMENTS

Figure 1:
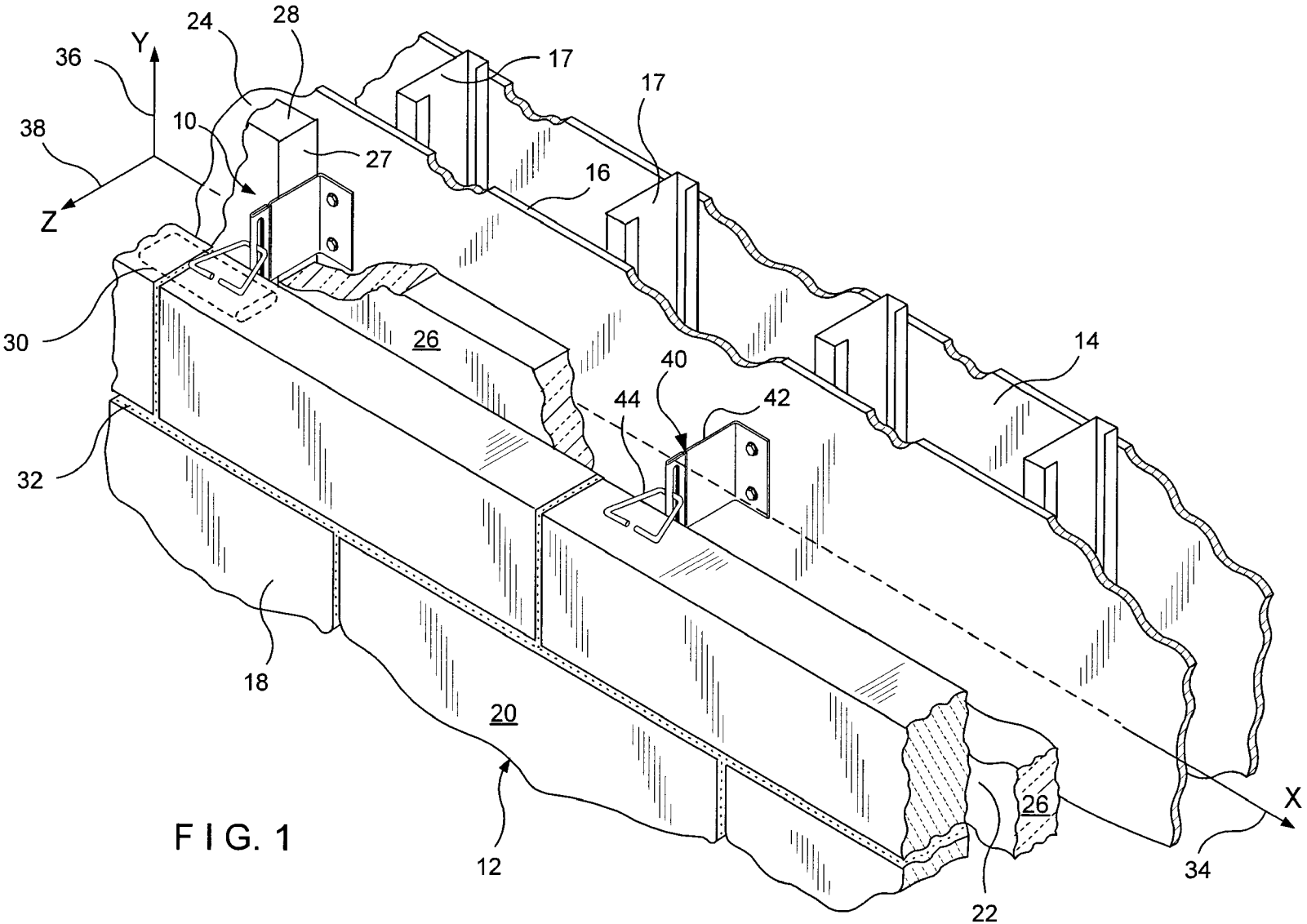
FIG. 1 shows a first embodiment of a high-wind load anchoring system of this invention and is a perspective view of the anchoring system as applied to the dry wall construction having exterior panel-type insulation and brick veneer.

The wind load anchors and high-wind load anchoring systems for cavity walls described herein address issues unique to the art of anchoring masonry veneers. Unlike any other structure-supporting building materials, wall anchors are relatively small, isolated assemblies that operate individually and in concert to shoulder the burden of severe forces bearing upon massive solid-wall constructs. The development and use of highly specialized anchoring systems is in response to the particular challenges associated with wind-loading of support walls and veneers mounted thereto and to the load bearing analysis thereof. This invention rigorously considers and resolves the complex and exacting demands created when high-wind loads, and seismic activity, threaten the structural and functional integrity of anchoring systems that support large-scale, commercial building structures. To this end, the high-wind load anchors and high-wind load anchoring systems of this invention serve, inter alia, to maintain anchor connection integrity to resist lateral forces without deformation of system components, and, under catastrophic conditions, to restrict displacement of the veneer.

This anchoring system, discussed in detail hereinbelow, has a high-strength wall anchor with a doubled-walled wing and a veneer tie. The base of the wall anchor is surface mounted on an insulated dry wall structure. In the first embodiment, the inner wythe of the cavity wall has an exterior panel-type insulation vertically disposed thereon. As the veneer being anchored is a brick veneer, the anchoring system includes sufficient vertical adjustment so as to avoid any misalignment.

Referring now to FIGS. 1 through 4, the first embodiment shows a surface-mounted anchoring system suitable for cavity wall constructs under high-wind load conditions. The high-wind load anchoring system for cavity walls is referred to generally by the numeral 10. A cavity wall structure 12 is shown having an inner wythe or dry wall backup 14 formed from sheetrock or wallboard 16 mounted on metal studs or columns 17. The cavity wall 12 also includes an outer wythe or facing 18 of brick 20 construction. Between the inner wythe 14 and the outer wythe 18, a cavity 22 is formed. Attached to the exterior surface 24 of the inner wythe 14 is insulation in the form of insulating panels 26. The insulation 26 is disposed on wallboard 16. Seams 28 between adjacent panels of insulation 26 are substantially vertical and the vertical edges 27 thereof abut the wing of the wall anchor surface mounted at the center of a column 17. The seams 28 seat to and about the wall anchor wings, thereby maintaining insulation integrity. The anchoring system 10 is also effective with other forms of insulation, such as loose insulation and spray-on insulation which are not shown.

Successive bed joints 30 and 32 are substantially planar and horizontally disposed and, in accord with building standards, are 0.375-inch (approx.) in height. Selective ones of bed joints 30 and 32, which are formed between courses of bricks 20, are constructed to receive therewithin the insertion portion of the veneer tie of the anchoring system hereof.

For purposes of discussion, the cavity surface 24 of the inner wythe 14 contains a horizontal line or x-axis 34 and an intersecting vertical line or y-axis 36. A horizontal line or z-axis 38, normal to the xy-plane, passes through the coordinate origin formed by the intersecting x- and y-axes.

Figure 2:
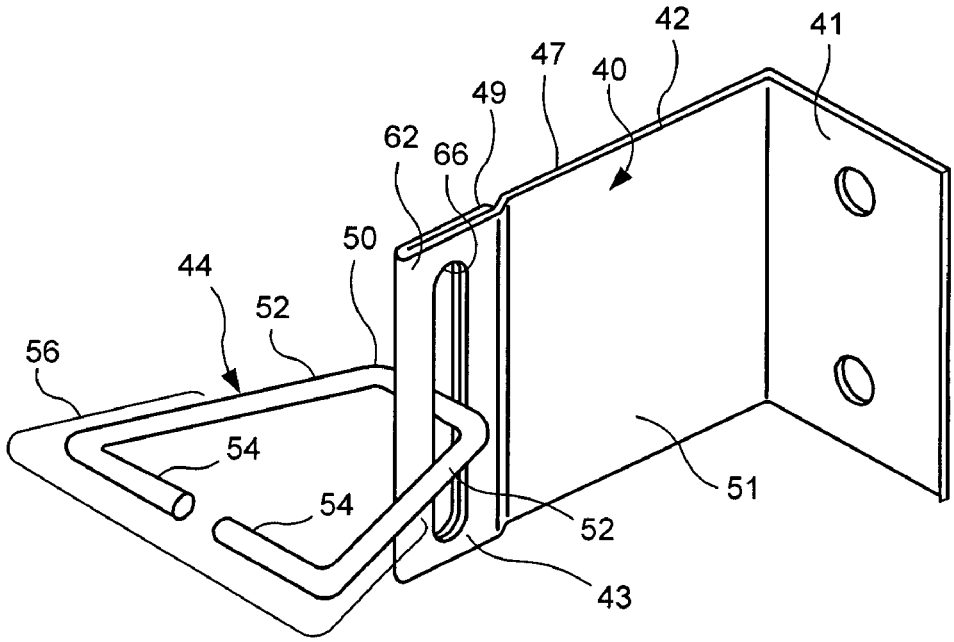
FIG. 2 is a perspective view of the system of FIG. 1 showing a double-walled, high-wind load wall anchor and a veneer tie threaded therethrough.
Figure 3:
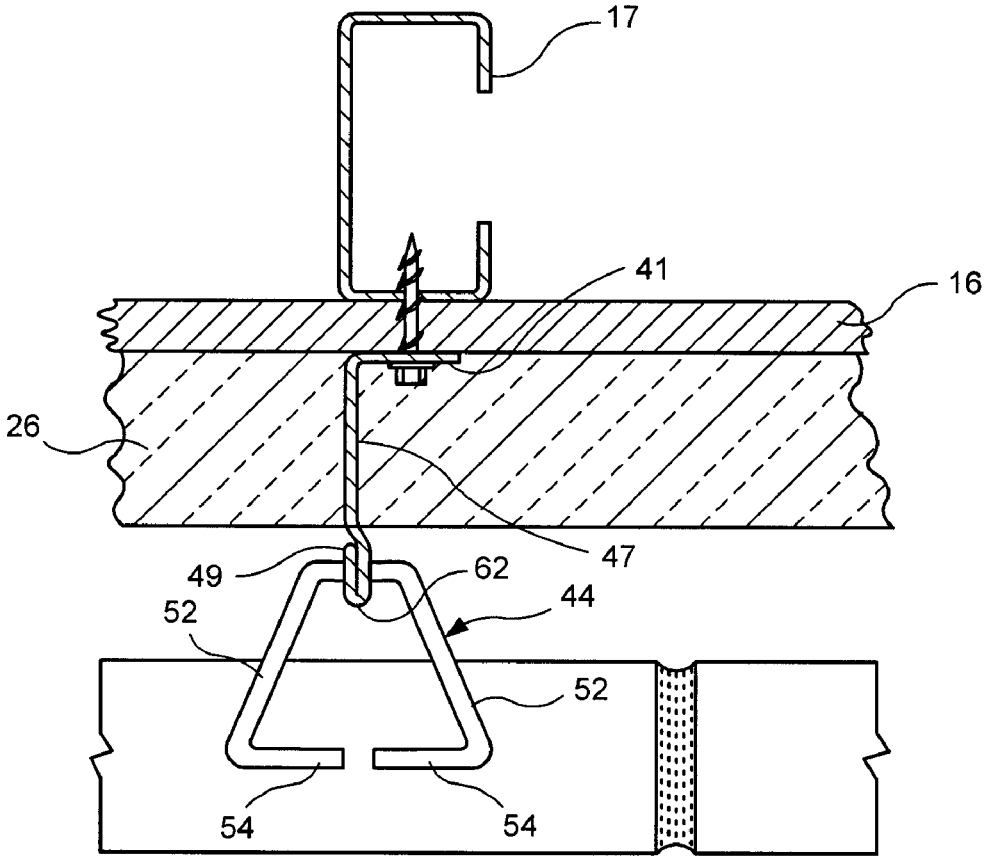
FIG. 3 is a cross sectional view of FIG. 1 along the xz-plane showing the relationship of the high-wind load anchoring system of this invention to the dry wall and the brick veneer.
Figure 4:
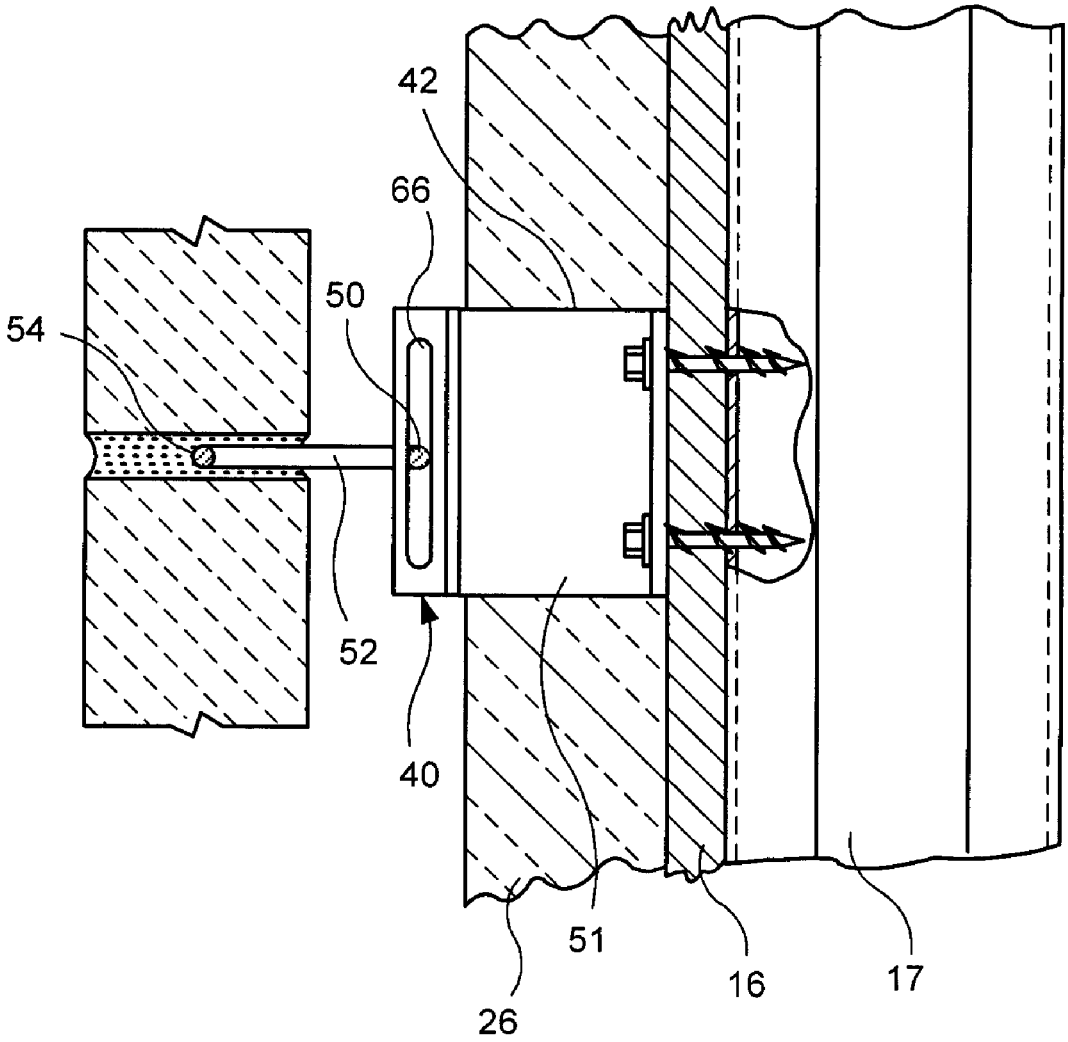
FIG. 4 is a cross sectional view of FIG. 1 along the yz-plane showing the relationship of the double-walled, high-wind load wall anchor of this invention to the dry wall construction with exterior panel-type insulation.

Referring now more particularly to FIG. 2, the wall anchor 40 is shown as an L-shaped structure which is surface mounted on the wallboard 16 at a base 41 and an arm 42 extends through the vertical seam 28 created between insulating panels 26. Upon installation, the arm 42 is disposed in the cavity 22, and contiguous therewith a double-walled wing 43 extends therefrom for interconnection with the veneer tie 44 through receptor 66.

In this embodiment, the system includes the wall anchor 40 and a veneer tie 44. Although other veneer ties work in conjunction with the wall anchor 40, the veneer tie 44 shown is a Byna-Tie® device manufactured by Hohman & Bamard, Inc., Hauppauge, N.Y. 11788. The veneer tie 44, shown in FIG. 1 as being emplaced on the course of bricks 20 in preparation for embedment in the mortar of the bed joint 30. The veneer tie 44 is then fixedly disposed in an x-z plane of the bed joint 30 and is constructed to adjustably position with the longitudinal axis substantially horizontal and to interengage with the wall anchor 40. A rear leg 50 of the veneer tie 44 is coextensive and substantially co-planar with a pair of side legs 52 and, upon installation, maintains continuous positive interengagement with the wall anchor 40. In this embodiment, the veneer tie 44 is preferably a trapezoidal configuration wherein the rear leg 50 is constructed to be threaded into the wall anchor 40 and the real leg 50 is dimensioned to limit side-to-side displacement. Front legs 54 and the adjacent portion of side legs 52 form the insertion portion 56 for embedment in the bed joint 30 of the outer wythe 18. The double-walled wing 43 measurably strengthens the resistive capacity of the anchoring system against high-wind forces bearing upon the outer wythe 18 and prevents veneer tie 44 deformation.

At intervals along a horizontal line surface 24, the wall anchors 40 are surface-mounted at the base 41 thereof. The wall anchors 40 are positioned on the surface 24 so that the intervals therebetween coincide with the insulating panel 26 dimension, e.g. 16-inch center-to-center. The arm 42 is proportioned so that the insulation panel 26, resting against the exterior surface 24 of the inner wythe 14, fits snugly between horizontally adjacent wall anchor 40 installations and does not occlude receptor 66. This construct maintains the insulation integrity of the system.

A double-walled wing 43, coextensive with arm 42 of the wall anchor 40, is contoured with a vertically elongated receptor or aperture 66 through which the veneer tie 44 is threaded. The aperture 66 is constructed to be within predetermined dimensions to restrict z-axis 38 movement. The dimensional relationship between the aperture 66 and the veneer tie 44 permits range of movement of the veneer tie 44 along the y-axis 36 while limiting z-axis 38 movement. As a result of this structural arrangement, the veneer tie 44 remains horizontally disposed within an x-z plane and external compressive force experienced by the face of the outer wythe 18 is maintained horizontally against along the veneer tie 44 and not broken into force components that would distort the veneer tie 44.

As shown in the first embodiment described above, the double-walled wing structure 43 improves the anchoring capability by increasing the material surrounding the receptor or aperture 66 and thereby strengthening the anchoring system interconnection with the veneer tie 44. This structure further improves the functional integrity of the high wind-load anchoring system, prevents distortion of the wall anchor 40 and provides enhanced connection security and stability.

In this embodiments, the double-walled wing structure 42 is formed from a single planar wall structure wrapped upon itself. Preferably, the double walled wing structure 43 is a sheetmetal stamping wherein the double wrapped walls are fused together while several joining techniques are suitable, the TOX joining technique is used here. Optionally, this embodiment of the double-walled structure 43 may be formed from two separate planar wall structures fused together along the facing wall surfaces. The improvement established by the preferred embodiment is the fused feature of the double-wall structure 43 which enhances the strength and performance of the wall anchor 40 by providing structural reinforcement to resist distortion under high-wind load conditions. The aforementioned TOX joining technique is a process by which one piece of metal is fused to another. Through the application of extremely high pressures, the metal begins to flow so that the two pieces fuse together as one.

A single-walled and double-walled (without the walls fused one to another) wall anchor 40 were placed under a pull test. In the testing, tension was applied at the aperture 66 of the wall anchor 40. In the case of a single-walled wall anchor 40, deformation began at 190 psi with failure occurring at 222 psi, or in terms of pounds of tension, 524 lbs. and 607 lbs., respectively. In the case of a double-walled (without the walls fused one to the other) wall anchor 40, deformation began at 310 psi with failure occurring at 365 psi, or in terms of pounds of tension, 855 lbs. and 1007 lbs., respectively. This demonstrates that even without fusing a double wall, a 60-65% improvement is experienced. As some of the test force was dissipated by the separation of the double wall, a fused structure as described herein above results in greater pull test advantage. Maximum pull resistance is achieved when the juncture of the double wall 49 is formed to align with the central plane 47 of the single planar wall 51.

Figure 5:
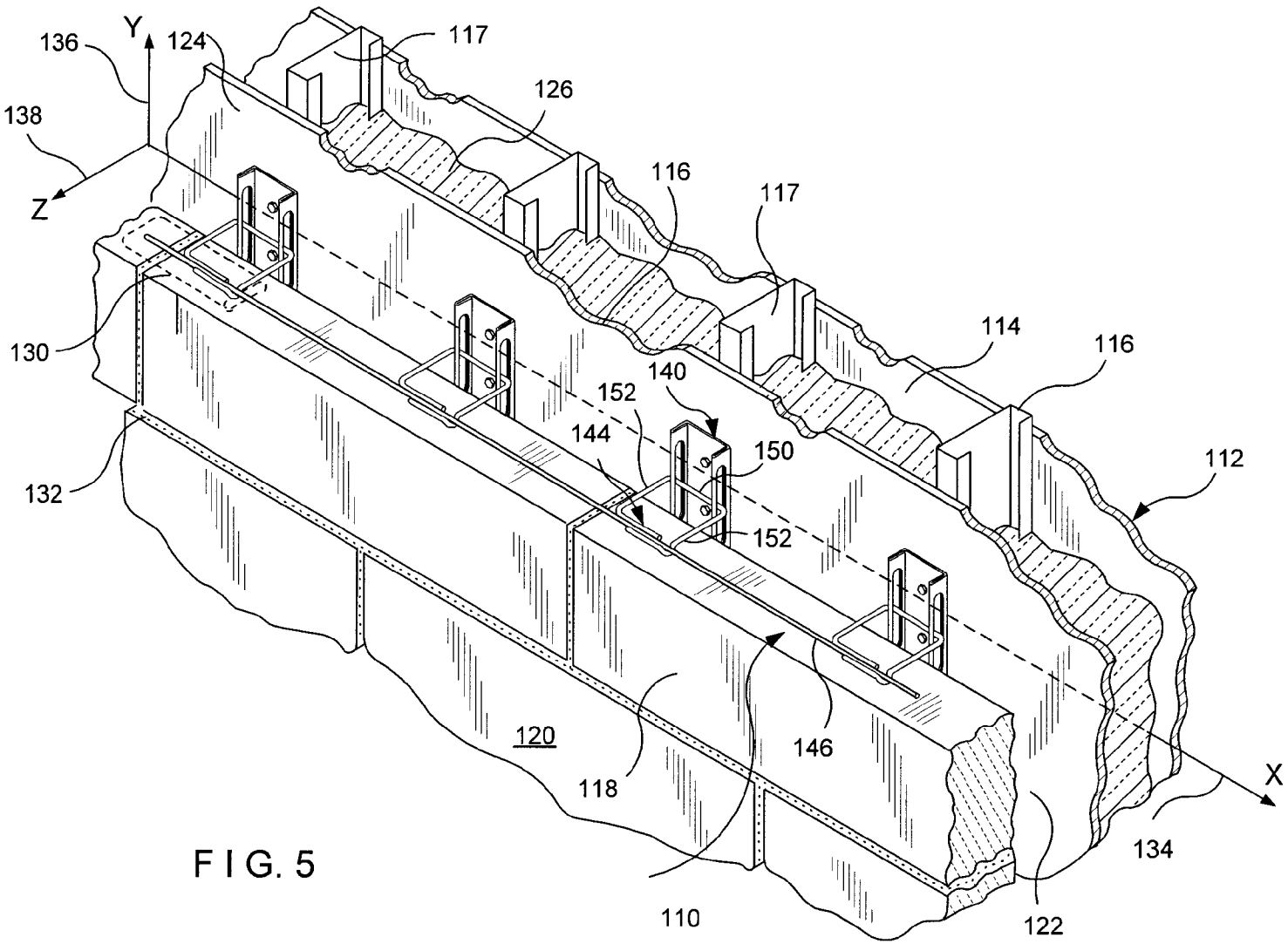
FIG. 5 shows a second embodiment of the high-wind load anchoring system of this invention, similar to FIG. 1, but showing a dry wall construction with interior insulation, a double-walled high-wind load wall anchor, a veneer tie, and the reinforcing wire snapped into the veneer tie.
Figure 7:
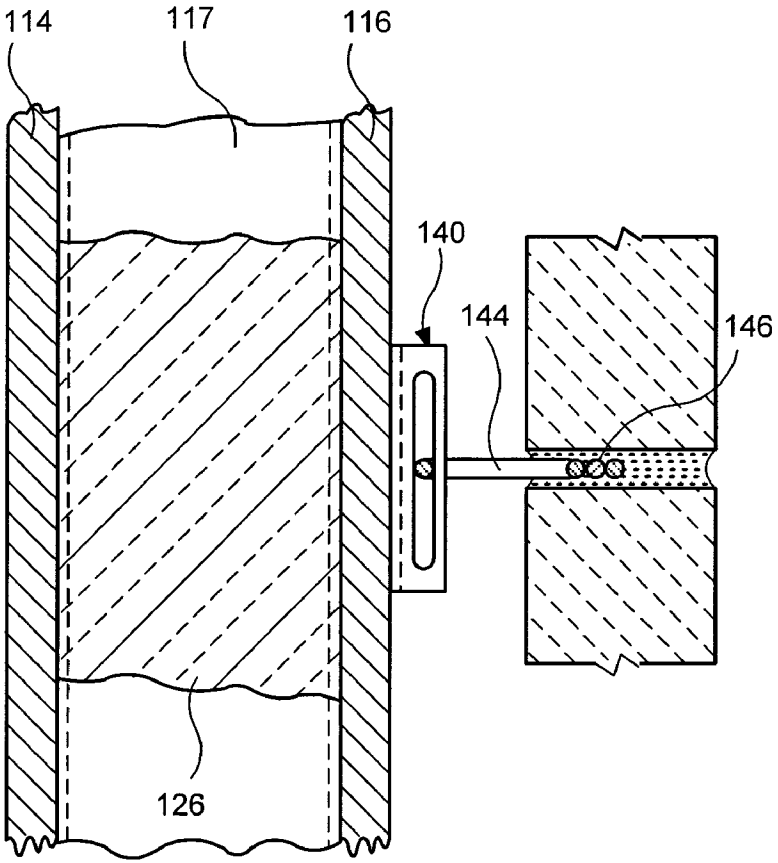
FIG. 7 is a cross-sectional view of FIG. 5 along the yz-plane showing the relationship of the double-walled, high-wind-wall anchor of this invention to the dry wall construction and the interior panel-type insulation.
Figure 6:
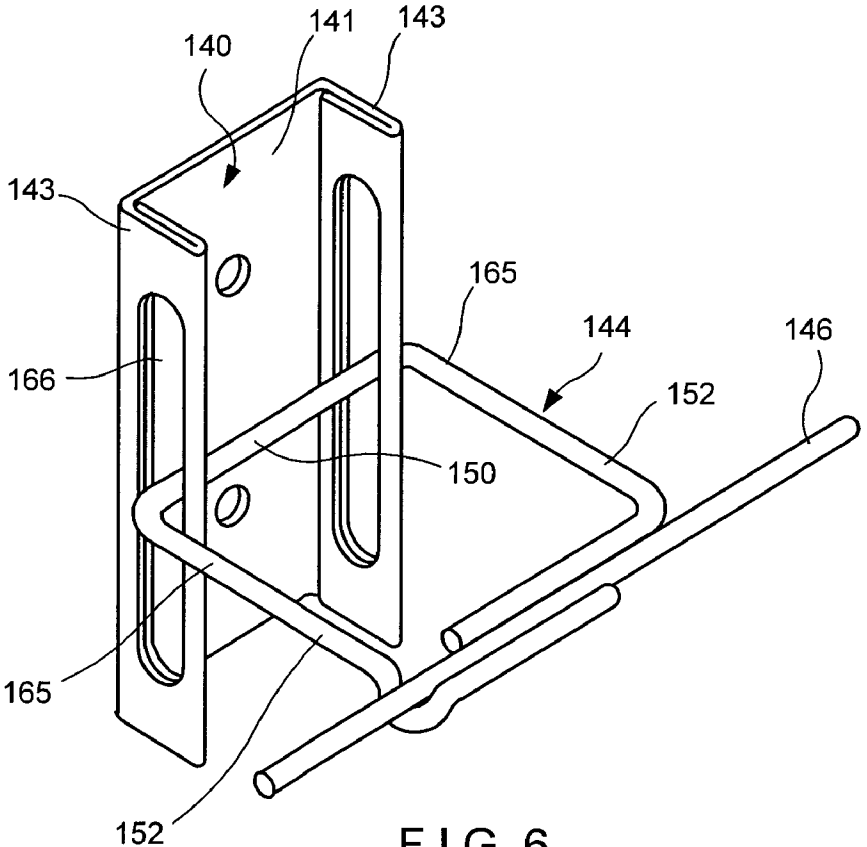
FIG. 6 is a perspective view of the high-wind load anchoring system of FIG. 5 shown with a high-wind load wall anchor having double-walled wings, a swaged veneer tie threaded therethrough and the reinforcing wire snapped into the veneer tie.

The description which follows is a second embodiment of the surface-mounted anchoring system for cavity walls of this invention. For ease of comprehension, wherever possible, similar parts use reference designators 100 units higher than those above. Thus, a veneer tie 144 of the second embodiment is analogous to the veneer tie 44 of the first embodiment. Referring now to FIGS. 5 through 7, the second embodiment of the surface-mounted anchoring system is shown and is referred to generally by numeral 110. As in the first embodiment, a cavity wall structure 112 is shown. The second embodiment has an inner wythe or backup wall 114 of a dry wall or a wallboard construct 116 on columns or studs 117 and an outer wythe or veneer 118 of brick 120. Here, the anchoring system includes a surface mounted wall anchor 140 with a pair of slotted, double walled wing portions 143 or receptors for receiving the veneer tie 144, and a reinforcement snap-in wire 146 which interengages with the veneer tie 144. The structural reinforcement provided by the snap-in wire 146 addresses the high-strength requirements associated with seismic conditions.

The anchoring system 110 is surface mounted to an exterior surface 124 of the inner wythe 114. In this embodiment, although many types of insulation can be used, batts of insulation 126 are shown disposed between adjacent columns 117. Successive bed joints 130 and 132 are substantially planar and horizontally disposed and, in accord with building standards, are 0.375-inch (approx.) in height. Selective ones of bed joints 130 and 132, which are formed between courses of bricks 120, are constructed to receive therewithin the insertion portion of the anchoring system construct hereof. Being surface mounted onto the inner wythe, the anchoring system 110 is constructed cooperatively therewith, and as described in greater detail below, is configured to penetrate through the wallboard at a covered insertion point.

For purposes of discussion, the cavity or exterior surface 124 of the inner wythe 114 contains a horizontal line or x-axis 134 and an intersecting vertical line or y-axis 136. A horizontal line or z-axis 138, normal to the xy-plane, passes through the coordinate origin formed by the intersecting x- and y-axes. The wall anchor 140 is constructed for surface mounting on the inner wythe 114 and for interconnection with the veneer tie 144.

The veneer tie 144 is shown in FIG. 5 as being emplaced on a course of bricks 120 in preparation for embedment in the mortar of bed joint 130. The veneer tie 144 is a swaged box Byna-Tie device manufactured by Hohman & Bamard, Inc., Hauppauge, N.Y. 11788. A rear leg 150 of the veneer tie 144 is coextensive, perpendicular and substantially co-planar with a pair of side legs 152 maintaining continuous positive engagement with the wall anchor 140. The side legs 152, terminating in an overlapping arrangement, are adapted for embedment in the bed joint 130 and swaged for receiving and securing the snap-in wire 146 disposed therewithin.

At intervals along a horizontal line surface 124, wall anchors 140 are surface-mounted at a base 141. The wall anchors 140 are positioned on the exterior surface 124 of the inner wythe 114 such that the longitudinal axis of column 117 lies within the yz-plane formed by the y-axis 136 of the base 141.

The wall anchor construct of the second embodiment is seen in more detail in FIGS. 6 and 7. Two double-walled wings 143, vertically disposed, extend horizontally from and coextensively with the base 141 of the wall anchor 140. Each double-walled wing 143 is contoured with a vertically elongated aperture 166 which interengages with the rear leg 150 of the veneer tie 144 that is threaded therethrough. The aperture 166 is constructed to be within predetermined dimensions to restrict movement along the z-axis. The dimensional relationship between the aperture 166 and the veneer tie 144 permits range of movement of the veneer tie 144 along the y-axis 136 while limiting z-axis 138 movement. As a result of this structural arrangement, the veneer tie 144 remains horizontally disposed within the x-z plane of bed joint 130 so that external compressive forces bearing against the face of the outer wythe 118 are transmitted along the veneer tie body 144 and not broken into components.

In this embodiment, insulation panels 126 are vertically disposed between successive metal columns 117 of the inner wythe 114 to minimize air and moisture penetration through the cavity 122 formed between the inner wythe 114 and the outer wythe 118 and maintain the insulation integrity of the system.

In the second embodiment, the improvement is the enhanced strength and performance of two double-walled wing 143 structures which distribute the burden of high-wind forces to resist deformation of the wall anchor 140 coupled with the snap-in wire structure 165 which provides reinforcement against seismic forces. This combination of features doubles the anchoring security and motion stability of the high-wind load anchoring system 110 of this invention.

The description which follows is a third embodiment of the high-wind load anchoring system for cavity walls of this invention. This description, wherever possible, will continue the numbering convention used above wherein similar parts use reference designators 100 units higher than those in the second embodiment. Thus, the veneer tie 144 of the second embodiment is analogous to a veneer tie 244 of the third embodiment.

Figure 8:
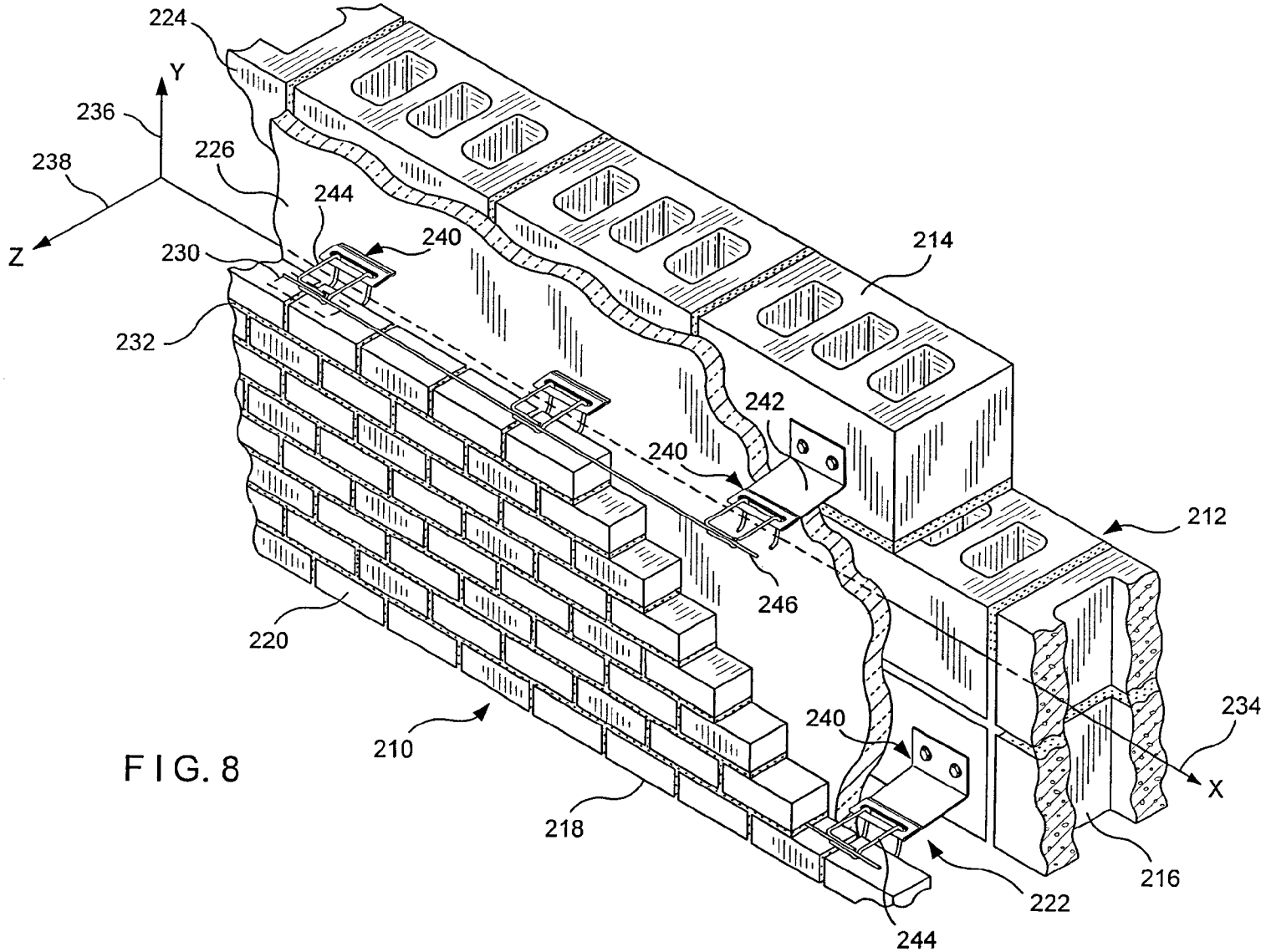
FIG. 8 shows a third embodiment of the high-wind load anchoring system of this invention and is similar to FIG. 1 but shows a masonry block backup wall with a sprayed exterior insulation.
Figure 10:
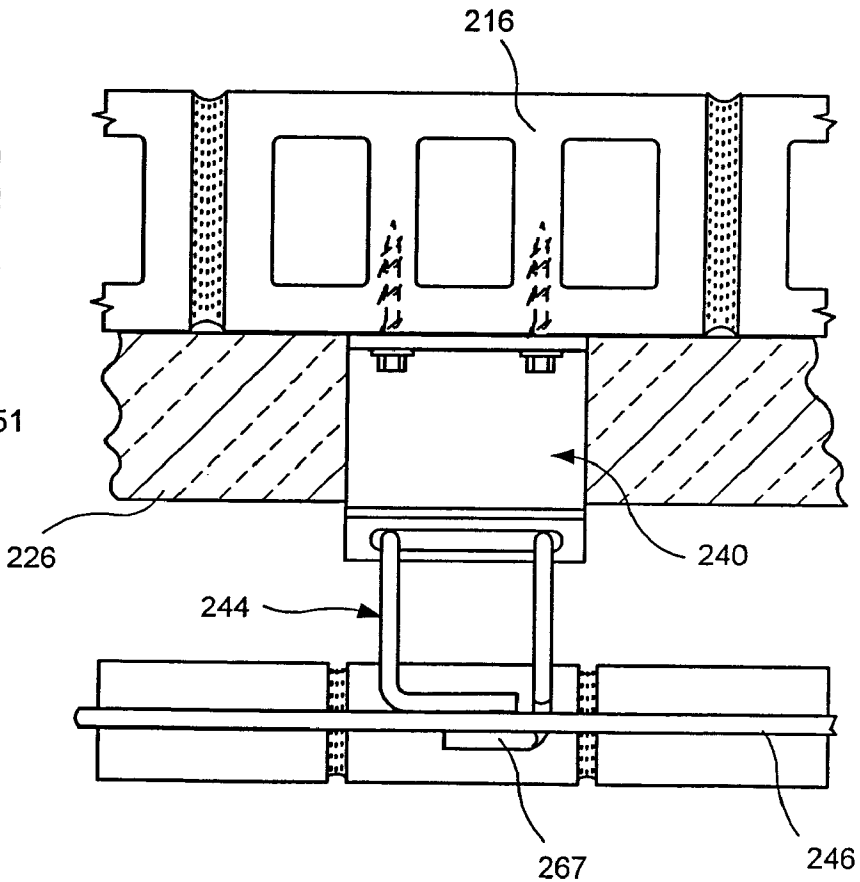
Figure 9:
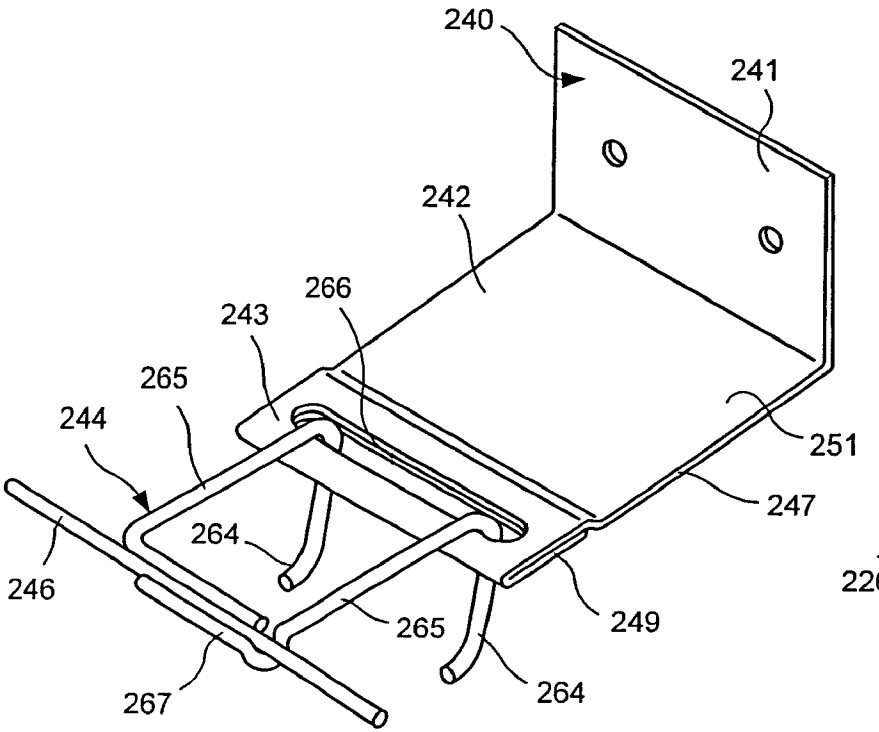
FIG. 9 is a perspective view of the high-wind load anchoring system of FIG. 8 shown with a double-walled, high-wind load wall anchor, a swaged veneer tie threaded therethrough and a reinforcing wire; and, FIG. 10 is a cross sectional view of FIG. 8 along the xz-plane showing the relationship of the double-walled, high-wind load wall anchor of this invention to the masonry block backup wall and the sprayed exterior insulation.

Referring now to FIGS. 8 through 10, the third embodiment of the surface-mounted anchoring system is shown and is referred to generally by numeral 210. An inner wythe 214 of cavity wall structure 212 has exterior spray-type insulation 226 disposed thereon, although other forms of insulation are available for use in the anchoring system. The third embodiment has an inner wythe or back-up wall 214 of masonry block 216 and an outer wythe or veneer 218 of brick 220. In this embodiment, the anchoring system has a surface mounted wall anchor 240 with a receptor arm 243 co-extending horizontally therefrom, a doubled-walled wing portion 243 contiguous with the receptor arm 242 and dimensioned for receiving the veneer tie 244, and a reinforcement snap-in wire 246 which interengages with the veneer tie 244. Here, as in the second embodiment, the structural reinforcement provided by the snap-in wire 246 resolves the high-strength requirements associated with seismic conditions. The wall anchor 240 is shown as an L-shaped structure which is surface mounted on the wall board 216 at the base 241. The receptor arm 242, extending laterally from the base 241 and is disposed in a cavity 222 formed between the inner wythe 214 and the outer wythe 218. The double-walled wing 243, co-planar and co-extensive with the receptor arm 242, is poised for interconnection with the veneer tie 244.

The veneer tie 244 is shown in FIG. 8 as being emplaced on a course of bricks 220 in preparation for embedment in the mortar of a bed joint 230. In this embodiment, a pair of side legs 265 of the veneer tie are co-extensive, perpendicular and substantially co-planar with a front leg 267 of the veneer tie 240. The pair of side legs 265 terminate in pintle structures 264 vertically disposed for interengagement with a horizontally elongated aperture 243 of the double-walled wing structure 243 of the wall anchor 240. The front leg 267 of the veneer tie 240 is swaged to securely receive and accommodate the snap-in wire 246.

At intervals along a horizontal line surface 224, the wall anchors 240 are surface-mounted at a base 241. Each wall anchor 240 is mounted at its base 241 upon the exterior surface 224 of the inner wythe 214 such that the mid-point longitudinal axis of a masonry block 216 lies within the yz-plane formed by the y-axis 236 of the base 241. Although the receptor arm 243 is dimensioned to accommodate many forms of insulation, spray-type insulation 226 is shown disposed along the exterior surface 224 of the inner wythe 214 to maintain the insulation integrity of the system.

The aperture 266 of the double-walled wing 243 is vertically elongated and the veneer tie 244 is threaded therethrough. The aperture 266 is constructed to be within predetermined dimensions to restrict z-axis 238 and x-axis 234 movement. The dimensional relationship between the aperture 266 and the veneer tie 244 permits range of movement of the veneer tie 244 along the y-axis 236 while limiting z-axis 238 and x-axis 234 movement. As a result of this structural arrangement, the veneer tie 244 remains horizontally disposed within the x-z plane of bed joint 230 so that any external compressive force bearing upon the face of the outer wythe 218 is transmitted along the veneer tie body 244 and not broken into components.

In the third embodiment, the improvement is the enhanced strength and performance of the double-walled wing structure 243 which absorbs the burden of high-wind forces to resist deformation of the wall anchor 240 coupled with the snap-in wire 265 structure which provides reinforcement against seismic forces, thereby providing improved connection security and motion stability to the high-wind load anchoring system 210 of this invention. Maximum pull resistance is achieved when the juncture of the double wall 249 is formed to align with the central plane 247 of the single planar wall 251.

Because many varying and different embodiments may be made within the scope of the inventive concept herein taught and because many modifications may be made in the embodiments herein detailed in accordance with the descriptive requirement of the law, it is to be understood that the details herein are to be interpreted as illustrative and not in a limiting sense.

What is claimed is:

1. A wall anchor comprising:

a base having a planar body of single-walled construction;

an arm extending outwardly orthogonal to the base, the arm being of single-walled construction and having two major surfaces, the surfaces having a central plane medial thereto; and a double-walled wing contiguous with said arm and extending therefrom, the double-walled wing extending orthogonal to the base and parallel to the arm, the double walled wing having opposing portions fused together to form a planar juncture therebetween, wherein the planar juncture of the double-walled wing aligns with the central plane of the arm for maximum pull resistance;

an aperture in said double-walled wing adapted to receive a veneer tie; and, wherein the wall anchor is formed from an elongate single sheet of material folded back on itself at one longitudinal end of the elongate sheet of material to form the double-walled wing.

2. A high-wind load anchoring system for use in a cavity wall having an inner wythe and an outer wythe, said outer wythe formed from a plurality of successive courses with a bed joint between adjacent courses, said inner wythe and said outer wythe in a spaced apart relationship forming a cavity therebetween, said high-wind load anchoring system comprising:

a wall anchor adapted for disposition in said cavity and upon said inner wythe, said wall anchor, in turn, comprising:

a base having a planar body, said base adapted for attachment to said inner wythe;

an arm extending outwardly orthogonal to the base, said arm being adapted to extend into said cavity upon installation, said arm having two major surfaces, said surfaces having a central plane medial thereto;

the base and arm being of single-walled construction;

a double-walled wing contiguous with said arm and extending therefrom, the double-walled wing extending orthogonal to the base and parallel to the arm, the wall anchor being formed from an elongate single sheet of material folded back on itself at one longitudinal end of the elongate sheet of material to form said double-walled wing, defining a planar juncture between opposing portions of the double-walled wing, the opposing portions of the double-walled wing being fused together for structural integrity, thereby forming the planar juncture, wherein said planar juncture of said double-walled wing aligns with said central plane of said arm for maximum pull resistance, whereby said double walled wing resists distortion resulting from high-wind forces impinging upon said outer wythe;

an aperture in said double-walled wing forming a receptor for a veneer tie; and, a veneer tie, said veneer tie, in turn, comprising:

an interengaging end, said interengaging end adapted to interengage with said wall anchor at said aperture; and an insertion end disposed opposite said interengaging end, said insertion end adapted for insertion into and embedment in said bed joint of said outer wythe, said insertion end, upon installation, being self-adjusting to a substantially horizontal position;

whereby external compressive forces exerted against said outer wythe are transmitted along said veneer tie.

3. A high-wind load anchoring system as described in claim 1 wherein said base is mounted to said inner wythe with said double-walled wing vertically disposed in said cavity.

4. A high-wind load anchoring system as described in claim 1 wherein said base is mounted to said inner wythe with said arm and said double-walled wing horizontally disposed in said cavity.

5. A high-wind load anchoring system as described in claim 1 wherein said cavity wall further comprises an insulative layer composed of at least one material selected from a group consisting of loose insulation, spray-on insulation, panel insulation and insulative batts.

6. A high-wind load anchoring system as described in claim 1 wherein said inner wythe is a dry wall construct having exterior insulation panels housed within said cavity, and wherein:

said arm is vertically disposed and extends horizontally from said base of said wall anchor, said arm dimensioned to align seamlessly with said insulation panel vertically nested therein to preclude penetration of air, moisture and water vapor into said exterior layer;

said double-walled wing is dimensioned to resist distortion of said wall anchor by high-wind forces;

said veneer tie comprising:

a rear leg;

a pair of side legs, coextensive and substantially co-planar with said rear leg, said pair of side legs adapted for embedment in said bed joint of said outer wythe so as to prevent disengagement from anchoring system; and, said aperture disposed within said double-walled wing is vertically elongated, wherein said veneer tie, dimensioned for thread-through said aperture, is vertically adjustable along said aperture and said aperture is dimensioned to minimize movement horizontally.

7. A high-wind load anchoring system as described in claim 6 wherein said veneer tie is a trapezoidal configuration having said rear leg narrowly disposed relative to said side legs, said trapezoidal configuration strengthening resistance of said veneer tie against deformation by high-wind forces impinging upon said outer wythe.

8. A high-wind load anchoring system as described in claim 6 wherein said base is surface mounted with attaching hardware upon an exterior surface of said dry wall along the vertical axis of a support column disposed within said inner wythe.

9. A high-wind load anchoring system as described in claim 8, wherein said anchoring system further comprises:

insulative sealing washers disposed on said attaching hardware thereby minimizing thermal transfer between said anchoring system and said inner wythe.

10. A high-wind load anchoring system as described in claim 1 wherein said inner wythe is a masonry block construct having a spray-type exterior insulation, and wherein:

said arm is horizontally disposed and extends horizontally from said base of said wall anchor, said arm dimensioned to align seamlessly with said spray-type insulation disposed along exterior surface of said masonry block to preclude penetration of air, moisture and water vapor into said exterior layer;

said double-walled wing dimensioned to resist distortion of said wall anchor by high-wind forces impinging upon said outer wythe;

a snap-in wire disposed in said bed joint of said outer wythe for reinforcement and resistance against seismic forces;

a front leg of said veneer tie swaged for receiving said snap-in wire and adapted for insertion into said bed joints of said outer wythe;

a pair of side legs of said veneer tie coextensive, perpendicular, and substantially co-planar with said front leg;

said aperture within said double-walled wing is horizontally disposed; and, a pair of pintles of said veneer tie coextensive with said pair of side legs and vertically disposed for thread through said aperture, said veneer tie being vertically adjustable along said aperture and said aperture dimensioned to minimize movement horizontally.

11. A high-wind load anchoring system as described in claim 1 wherein the double-walled wing comprises a first wall portion, and a second wall portion in opposed relation to the first wall portion, the first wall portion being connected to a free end of the arm by a bend so that the first wall portion is offset laterally of the arm.

* * * * *

UNITED STATES PATENT AND TRADEMARK OFFICE

CERTIFICATE OF CORRECTION

PATENT NO. : 8,201,374 B2
APPLICATION NO. : 12/422082
DATED : June 19, 2012
INVENTOR(S) : Ronald P. Hohmann, Jr.

It is certified that error appears in the above-identified patent and that said Letters Patent is hereby corrected as shown below:

In the Claims

Column 11, Claim 3, line 28 “claim 1” should read -- claim 2 --

Column 11, Claim 4, line 31 “claim 1” should read -- claim 2 --

Column 11, Claim 5, line 35, “claim 1” should read -- claim 2 --

Column 11, Claim 6, line 40, “claim 1” should read -- claim 2 --

Column 12, Claim 10, line 23, “claim 1” should read -- claim 2 --

Column 12, Claim 11, line 49, “claim 1” should read -- claim 2 --

Signed and Sealed this
Tenth Day of December, 2013

Margaret A. Focarino

Margaret A. Focarino
*Commissioner for Patents of the United States Patent and Trademark Office*